US007578090B1

(12) United States Patent
Romaszka

(10) Patent No.: US 7,578,090 B1
(45) Date of Patent: Aug. 25, 2009

(54) MUZZLE GUARD STRIKE PLATE FOR AUTOMATIC PISTOLS

(76) Inventor: John A. Romaszka, 6082 Old Guide Rd., Bellingham, WA (US) 98226

( * ) Notice: Subject to any disclaimer, the term of this patent is extended or adjusted under 35 U.S.C. 154(b) by 276 days.

(21) Appl. No.: 11/476,363

(22) Filed: Jun. 27, 2006

Related U.S. Application Data

(60) Provisional application No. 60/694,610, filed on Jun. 27, 2005.

(51) Int. Cl.
*F41C 27/00* (2006.01)
*F41A 35/00* (2006.01)

(52) U.S. Cl. ..... 42/96; 42/90; 42/85

(58) Field of Classification Search ..... 42/51, 42/79, 83, 85, 86, 90, 96
See application file for complete search history.

(56) References Cited

U.S. PATENT DOCUMENTS

| | | | | | |
|---|---|---|---|---|---|
| 6,124 | A * | 2/1849 | Smith | 42/51 |
| 2,467,270 | A * | 4/1949 | Patchett | 42/86 |
| 2,805,507 | A * | 9/1957 | Buquor | 42/53 |
| 2,823,481 | A * | 2/1958 | Walter | 42/93 |
| 3,076,280 | A * | 2/1963 | Bervoets | 42/86 |
| 3,613,283 | A * | 10/1971 | Mozey, Jr. | 42/86 |
| 3,950,877 | A * | 4/1976 | Musgrave | 42/90 |
| 4,327,515 | A * | 5/1982 | Kuryn | 42/90 |
| 4,641,451 | A * | 2/1987 | Harris | 42/85 |
| D328,632 | S * | 8/1992 | Bigwood | D22/108 |
| 7,194,836 | B1 * | 3/2007 | Urban | 42/60 |

* cited by examiner

*Primary Examiner*—Bret Hayes
(74) *Attorney, Agent, or Firm*—Todd N. Hathaway

(57) ABSTRACT

A strike plate unit that mounts to an automatic pistol to prevent the barrel and the slide of the pistol from being pushed rearwardly out of battery. The strike plate unit mounts to the accessory rail under the barrel of the pistol, and includes a secondary accessory rail that enables lights and other accessories to be attached under the strike plate unit while the latter is mounted to the pistol. The rearward face of the strike plate is positioned forwardly of the muzzle end of the barrel, to create a gap through which gasses escape in upward and outward directions to create a muzzle brake effect. The forward face of the plate is provided with heavy, sharply-pointed checkering that enhances its effectiveness as a striking weapon/tool.

16 Claims, 4 Drawing Sheets

MUZZLE GUARD STRIKE PLATE FOR AUTOMATIC PISTOLS

RELATED CASES

This application claims the benefit of Provisional Patent Application Ser. No. 60/694,610 filed on Jun. 27, 2005.

BACKGROUND a. Field of the Invention

The present invention relates generally to muzzle guards for firearms, and, more particularly, to a strike plate for preventing the slide of an automatic pistol from being pushed out of battery by an impact to the muzzle.

b. Related Art

The majority of modern automatic pistols employ full-length slides in which the barrel and its associated mechanisms are housed. In most designs, recoil upon firing of the pistol causes the barrel and slide to move rearwardly together for a short distance, after which the slide continues its rearward movement so as to open the breach and eject the shell of the spent cartridge. A spring or springs return the slide in a forward direction, so that it strips a fresh cartridge from the clip and chambers it in the barrel. The barrel and slide then move forwardly together to the firing position.

The initial range of motion, where the slide and barrel first move rearwardly together, releases the barrel from its firing position and moves it "out of battery". When the barrel is out of battery, the trigger and firing pin mechanism is disabled. As a result, even a slight rearward movement of the slide and barrel will render it impossible to fire the cartridge even though it is chambered in the barrel.

This characteristic is near universal among the most advanced and modern types of pistols; it is an inherent aspect of their operation and is, in some respects, a desirable safety feature. Such pistols include, for example, the 9 mm Glock™ pistol that is widely utilized by Western security and special forces organizations.

Since the foregoing characteristics have been commonplace in automatic pistols of one caliber or another for over a century, they are well known to both friend and foe alike. Consequently, one tactic that has been adopted for close-quarters combat (e.g., hand-to-hand combat in a dwelling) is to strike the muzzle of an opponent's gun with a hand or other object, so that the pistol is disabled, while attacking the opponent with the other hand. This tactic poses an increasing problem with the need to combat fanatical and desperate opponents who frequently hide and fight within civilian buildings.

Moreover, in close quarters combat it sometimes occurs that the pistol must be discharged with its muzzle pressed directly against the body of the opponent. If, however, the opponent is wearing body armor (or if the muzzle happens to be pressed against a hard object that is being carried or worn by the opponent) the body will not yield and instead the barrel and slide may be forced rearwardly and out of battery so that the pistol cannot be fired.

Still further, certain tactics call for the muzzle end of the pistol to be used as a striking tool or weapon; for example, the muzzle may be employed to break out the window of an automobile in order to gain access to the interior and/or occupants. However, the design of the muzzle is typically optimized for operation of the firearm itself, not for use as a striking tool, so it is generally deficient for this purpose in terms of mass, strength and other characteristics.

Certain efforts have been made to address one or more of these problems. However, the prior devices have generally been unsatisfactory in one or more respects: For example, some have required modification of the pistol itself, at significant expense, and have employed mountings, that are not easily detached in a field environment; the latter is a significant drawback, since in most cases the front of the barrel and slide must be unobstructed in order to field strip the pistol. Moreover, prior efforts have frequently focused on the US M1911 .45ACP service pistol, an obsolescent (if still popular) weapon that lacks features and aspects associated with modern pistol design, typified by the Glock™ (e.g., Glock 17) pistols noted above.

Accordingly, there exists a need for an apparatus that will protect the muzzle end of an automatic pistol so as to prevent the barrel and slide from being pushed back out of battery by an impact thereto. Furthermore, there exists a need for such an apparatus that significantly improves the characteristics of the muzzle end of the pistol as striking weapon or tool. Still further, there exists a need for such an apparatus that can be easily and quickly detached from the pistol for field stripping of the weapon. Still further, there exists a need for such an apparatus that cooperates with and enhances the features provided by modern pistol designs, as exemplified by the Glock™ series of pistols.

SUMMARY OF THE INVENTION

The present invention has solved the problems cited above, and is a strike plate unit that is mountable to the accessory rail of a modern automatic pistol. In a broad aspect, the strike plate unit comprises a plate portion for being positioned generally in front of the muzzle end of the pistol so as to prevent the barrel and slide of the pistol from being pushed rearwardly out of battery; a base portion extending from a lower end of the plate portion for being positioned generally beneath the barrel of the pistol; a mounting channel formed in the upper side of the base portion for receiving an accessory rail of the pistol in mounting engagement therewith; and a secondary accessory rail formed on a bottom side of the base portion for attachment of lights and other accessory items thereto.

The strike plate unit may further comprise a transverse bore formed through the mounting channel of the base portion that aligns with a locking notch in the accessory rail on the pistol, and a pin member that passes through the transverse bore and notch so as to form a locking engagement between the strike plate unit and the accessory rail of the gun.

The mounting channel in the base portion of the unit may be sized slightly narrower in width than the accessory rail on the pistol, so as to form a sliding interference engagement therewith that stabilizes the strike plate unit on the pistol.

The plate portion of the unit may comprise a forward face having large, pointed checkering that defines a plurality of spaced, sharply pointed tips. The tips may lie substantially in a common plane so that the forward face is free of elongate, individual protrusions.

The rearward face may be positioned so as to be located a spaced distance forward of the barrel end of the pistol so as to form a gap through which gasses escape upwardly and outwardly upon firing of the pistol, so as to create a compensating force that counters muzzle rise due to recoil of the pistol. The gap may have a spacing of about 1/32 inch.

The strike plate unit may be formed of high strength aluminum alloy having an anodized finish.

These and other features and advantages of the present invention will be more fully understood from a reading of the following detailed description with reference to the accompanying drawings.

DETAILED DESCRIPTION

Figure 1:
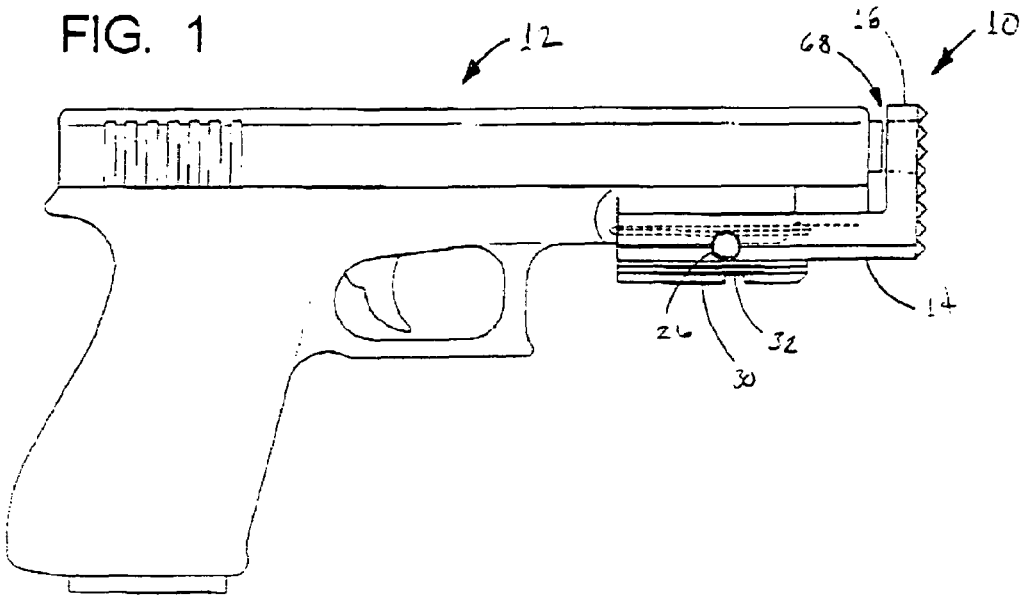
FIG. 1 is a side, elevational view of a muzzle strike plate in accordance with the present invention, mounted to an exemplary Glock™ automatic pistol.

FIG. 1 shows a strike plate unit 10 in accordance with the present invention, mounted to the muzzle end of an exemplary automatic pistol 12. The preferred embodiment that is shown in the figures is especially suited for use with Glock™ pistols of the type noted above, however it will be understood that the invention may also be configured for use with other makes and models of pistols having underbarrel accessory rails similar to those of the Glock™; examples include the HK™ USP and Mark23 "Socom", the FN Five-seveN™, and the SIG™ 220 series.

Figure 2:
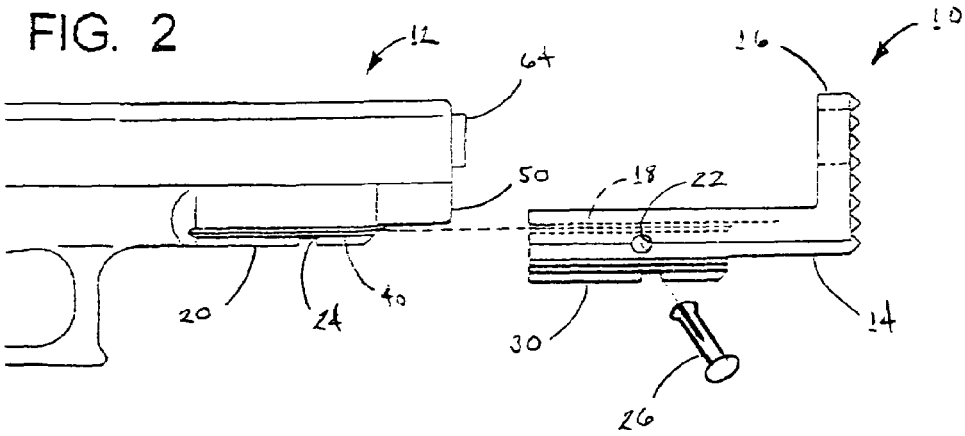
FIG. 2 is a side, elevational view of the strike plate and pistol of FIG. 1, with the strike plate being removed from the pistol so as to show the mounting structure in greater detail.

As can be seen in FIGS. 1-2, the strike plate unit 10 includes an elongate base portion 14 that extends beneath the barrel, and a front plate portion 16 that extends upwardly in front of the barrel and slide.

As will be described in greater detail below, the base portion includes a mounting channel 18 that slides onto and engages the standard underbarrel accessory rail 20 of the pistol. A bore 22 extends transversely across the bottom of the mounting channel, so as to be in alignment with a transverse notch 24 that is a standard feature of the mounting rail (for engaging a spring-loaded locking mechanism commonly used on lights and other accessories that are designed for use with the gun). A locking pin 26 is passed through the bore 22 and engages the notch 24 so as to lock the strike plate unit in place.

Figure 8:
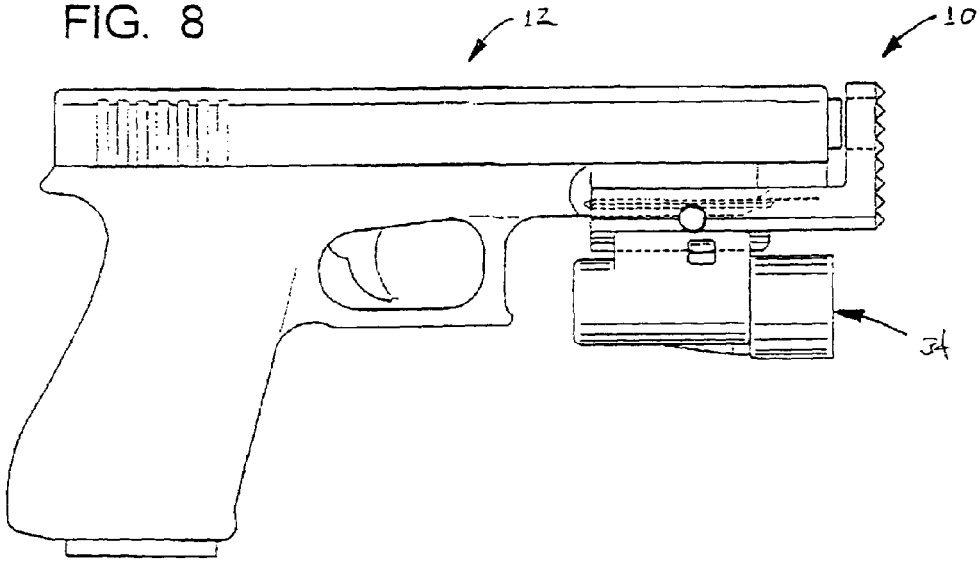
FIG. 8 is a side, elevational view of the strike plate unit and pistol, similar to FIG. 1, showing the manner in which a light or other accessory attaches to the secondary accessory rail on the bottom of the strike plate unit.

The underside of the base portion 14 is provided with a depending, longitudinally extending accessory rail 30. As will be described in greater detail below, the accessory rail 30 is substantially identical in cross-section to the original accessory rail 20 on the gun itself, and includes a substantially identical locking notch 32. The secondary accessory rail extends parallel to that on the gun, only being offset therefrom by a short vertical distance. The secondary accessory rail therefore allows lights and other accessories to be mounted to the rail in a conventional fashion, such as the light unit 34 (for example, an M3 Tactical Illuminator available from Streamlight, Norsetown, Pa. 19403) as shown in FIG. 8. Accordingly, the present invention provides a strike plate unit that can be mounted to the pistol while still allowing use of the lights, lasers and other accessories that are a key advantage of modern pistol design and equipment.

Having provided an overview of the invention, the features and aspects thereof will now be described in greater detail.

As can be seen in FIGS. 3-7, the strike plate unit 10 is preferably formed as a unitary, one-piece structure (except for the mounting pin 26). Any rigid high strength material may be used, however, high strength aluminum alloy with an anodized finish is preferred due to several advantages, including low added weight, high strength, durability and resistance to corrosion in a field environment. The unit may be formed, for example, of CNC machined aluminum billet (suitably, 6061 T6 aluminum alloy).

Figure 4:
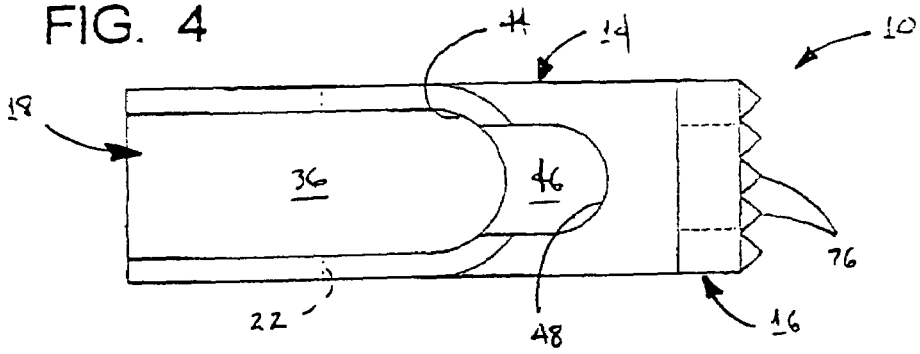
FIG. 4 is a top, plan view of the strike plate unit of FIG. 3, showing the configuration of the mounting channel thereof in greater detail.
Figure 5:
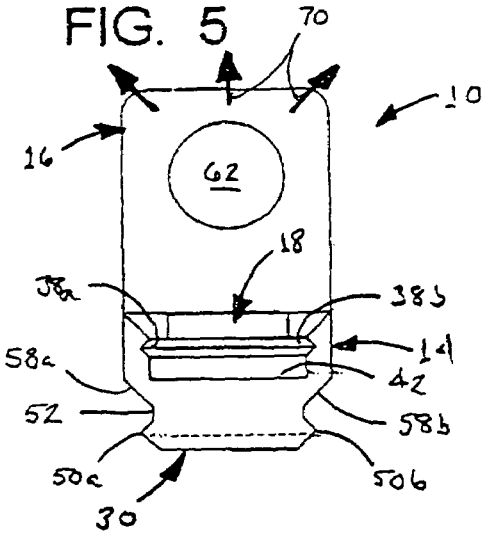
FIG. 5 is a rear, elevational view of the strike plate unit of FIGS. 3-4, showing the relationship of the mounting channel and secondary accessory rail thereof in greater detail.

As noted above, the mounting channel 18 is configured to slide into place on the accessory rail of the gun, which in turn is substantially identical in cross-section to the secondary accessory rail 30 on the bottom of the strike plate unit. Accordingly, as can be seen in FIGS. 4-5, the mounting channel includes a longitudinally extending, channel-shaped opening 36 for receiving the guide rail on the gun, with grooves 38*a*, 38*b* on either side for receiving and engaging the cooperating ridges 40 on the accessory rail. The receiving opening 36 is open at its rearward end and is closed along the bottom by a lower wall 42. At its forward end, the opening is closed by a semi-circular wall 44 that is interrupted along the centerline by a secondary channel opening 46 that terminates in a second U-shaped wall 48, and that accommodates a projection 50 at the bottom of the muzzle of the gun (see FIG. 2). Terminating the two channel opening in the U-shaped walls has the advantage of facilitating economical manufacture of the component by CNC machining.

Although the cross-section of the mounting channel closely matches the external profile of the accessory rail 20, the former is preferably sized slightly smaller in width (e.g., by about 1-3 thousandths of an inch). The slightly undersized channel cooperates with the somewhat yielding polymer material of the frame (polymer frames being a common feature of modern pistols intended for tactical use) to establish a firm, sliding interference fit. The interference fit ensures accurate alignment and a stable engagement between the strike plate unit and the gun; the latter aspect is important not only to prevent the strike plate unit from moving/shifting in a manner that might cause wear and looseness when firing the gun, but also to provide the overall assembly with rigidity that increases the effectiveness of the gun as a striking weapon/tool.

Figure 7:
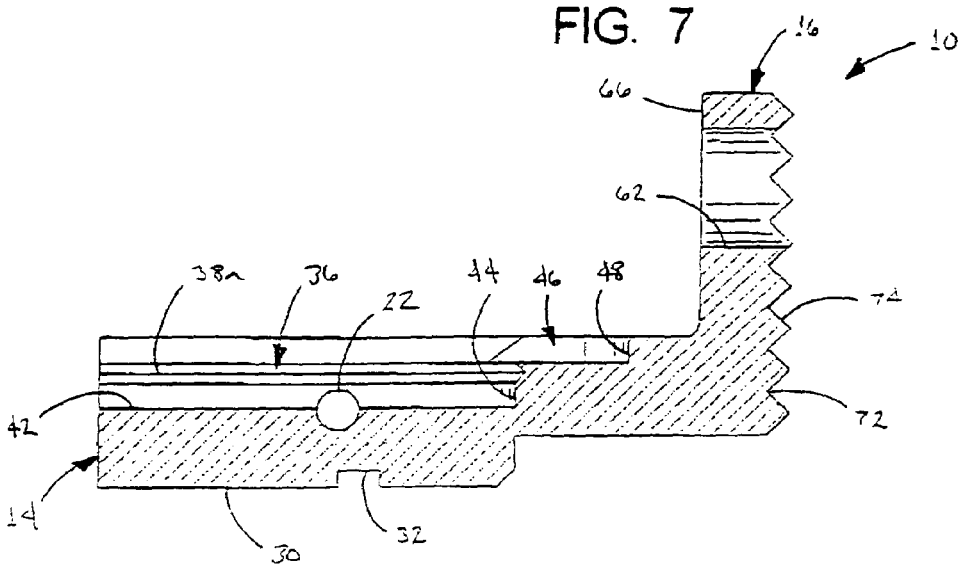
FIG. 7 is a cross-sectional view of the strike plate unit of FIGS. 3-6, showing the relationship of the mounting channel and locking pin bore thereof in greater detail.
Figure 9:
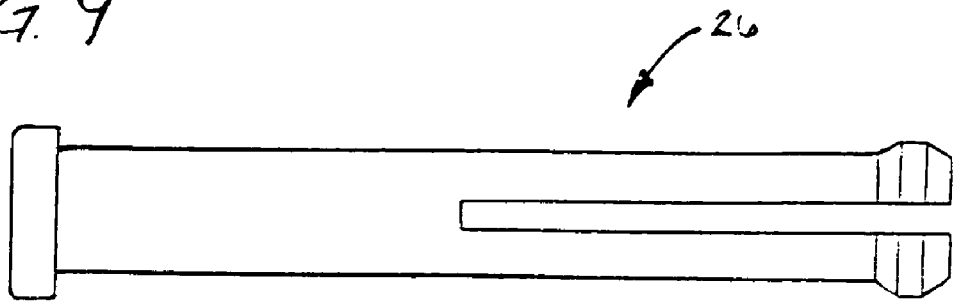
FIG. 9 is an elevational view of the locking pin of the strike plate unit of FIGS. 1-2, showing the configuration of the pin in greater detail.

As can be seen in FIG. 7, the bore 22 for the mounting pin extends upwardly above the floor 42 of the mounting channel, so that the upper portion of the pin will be received in the locking notch 32 of the accessory rail. This enables a plain, cylindrical pin to be used in place of the complex spring-loaded latching mechanisms with which the lights or other accessories (e.g., targeting lasers) are ordinarily equipped, while still allowing the pin to have a diameter sufficiently large that it will be strong enough to hold a plate unit in place when subjected to heavy striking/impact forces. In the illustrated embodiment, the locking pin 26 is suitably an elongate aluminum shaft having one end of the shaft being longitudinally split and provided with tapered shoulders, as shown in FIG. 9, so that the enlarged end will compress in order to pass through the bore and then "snap" back out resiliently on the opposite side of the unit to lock the pin in place. This configuration has the significant advantage of allowing the pin, and therefore the strike plate unit, to be removed without tools, however, it will be understood that other forms of locking pins may be used; for example, in some instances the locking pin may be an internally threaded post that receives a screw entered from the opposite side. Moreover, it will be understood that in some instances other forms of locking mechanisms may be utilized, such as other types of locking pins, or even the spring-loaded latch mechanism noted above.

Figure 3:
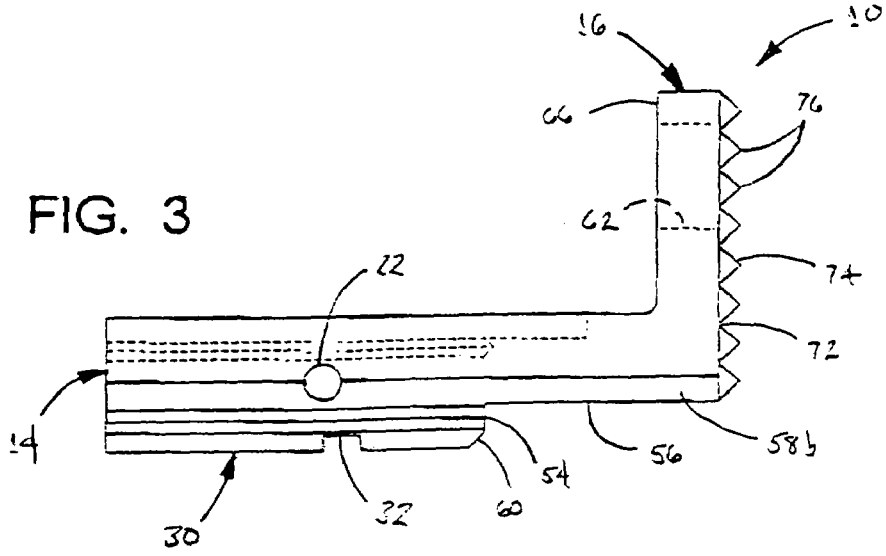
FIG. 3 is a side, elevational view of the strike plate unit of FIGS. 1-2, enlarged to show the structure thereof in greater detail.
Figure 6:
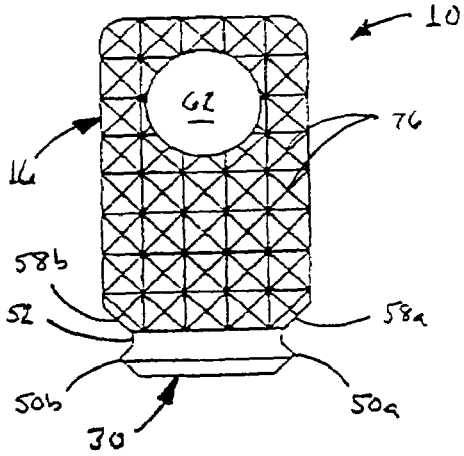
FIG. 6 is a front, elevational view of the strike plate unit of FIGS. 3-5, showing the configuration of the raised and pointed checkering thereof in greater detail.

As was noted above, the secondary accessory rail 30 on the bottom of the strike plate unit is substantially identical in cross-section to the original accessory rail on the gun itself. Consequently, as can be seen in FIGS. 5-6, the secondary rail 30 includes elongate side ridges 50*a*, 50*b* and an overlying narrowed portion 52, for being received in the mounting portion of a light or other accessory. However, as can be seen in FIG. 3, the forward end 54 of the secondary accessory rail terminates a significant, spaced distance rearwardly of the plate portion 16, creating a flat contact face 56 on the bottom of the lower portion 14, that is bordered by beveled longitudinal side edges 58*a*, 58*b*. The contact surface has a length that corresponds to a significant portion of the length of the mounting portion of the light or other accessories to be used; preferably, the contact surface has a length that is equal to or greater than one-half the length of the mounting groove of the accessory. The contact surface and beveled edges serve to aid in initially positioning the light or other accessory at the front of the secondary accessory rail 30, by simply pressing the mounting portion of the light or other accessory upwardly against the bottom of the strike plate unit in this area. The operator can then simply slide the light or other accessory rearwardly onto the rail 30, with the initial engagement being eased by beveled forward edge 60 on the rail. Mounting the light or other accessory to the secondary rail can therefore be done very quickly and easily, in the dark or under stressful circumstances, by simply "slapping" the accessory up against the contact surface 56 and then pulling it rearwardly, as opposed to having to "fiddle" with the alignment between the rail and the grooves before the accessory can be slid into place.

As can be seen in FIG. 3, the front plate portion 16 extends upwardly from the forward end of the base portion 14, substantially at a right angle thereto, so as to follow the general profile of the muzzle but at a location spaced forwardly therefrom. The plate portion includes a main bore 62 in its upper part that aligns coaxially with the forward end 64 of the barrel (see FIG. 2), for passage of bullets therethrough. The plate preferably covers the entire forward end of the barrel and slide; for use with the Glock™ pistols noted above, the plate member suitably has dimensions of 1 inch (width) by 1⅝ inches (height), with a total thickness of about ⅜ inch.

When mounted to the accessory rail of the gun as described above (i.e., with the locking pin in engagement with the notch 32 of the accessory rail), the rearward face 66 (see FIG. 7) of the front plate portion is positioned just forward (suitably by about 1/32 inch) of the barrel end 64 so as to create a gas release gap 68. When the weapon is discharged, the gases from the muzzle blast escape through the gap 68 and imping against the rearward face 66 of the vertical plate portion. The lower end of the surface 66 is blocked by the base portion 14, so that the majority of the released gas escapes in an upward and outward direction, as indicated by arrows 70 in FIG. 5. This serves to generate a pronounced "muzzle brake" or compensator action that helps to reduce muzzle rise due to recoil, helping with control and accuracy of the weapon, especially when firing a rapid series of shots. Controllability of the gun under such circumstances is also enhanced by the mass of the plate portion that is positioned at the muzzle, without significantly increasing the overall weight of the weapon.

Allowing a portion of the gases to escape between the plate portion and barrel end also has the advantage of breaking up and reducing the flash signature of the weapon, decreasing exposure of the operator to targeting by hostile fire.

The forward surface 72 of the plate portion, in turn, is provided with large, heavy checkering 74 that defines a plurality of sharply pointed, spaced-apart tips 76 lying generally in common plane. The sharply pointed checkering not only significantly enhances effectiveness when the gun is utilized as a striking weapon against an opponent, but also provides an effective implement for initiating cracks in and shattering glass when breaking through a vehicle window or the like, without relying on an elongate spike or other projection that may interfere with upholstering and handling of the weapon in a tactical situation. Checkering having 36 points per square inch and a depth of about 3/32 inch has been found eminently suitable.

Accordingly, the present invention provides a strike plate unit that is durable and highly effective, both for preventing the barrel/slide from being pushed out of battery and for being used as a strike weapon/tool. Moreover, the strike plate unit can be used with a Glock™ or other modern pistol without negating the ability to use lights, targeting lasers and other accessories that are designed to mount to the accessory rail thereof. Moreover, the unit is simple to use, is easily removed and replaced in a field environment, and is economically manufactured using conventional materials and techniques.

It is to be recognized that various alterations, modifications, and/or additions may be introduced into the constructions and arrangements of parts described above without departing from the spirit or ambit of the present invention.

What is claimed is:

1. A strike plate unit for being mounted to a pistol having a slide and a barrel having a muzzle end, and an accessory rail located below said slide and barrel, said accessory rail having a locking notch formed therein, said strike plate unit comprising:

a base portion having a mounting channel on an upper side thereof for receiving said accessory rail of said pistol in mounting engagement therewith so as to position said base portion generally beneath said barrel of said pistol;

a plate portion that extends from said base portion so as to be positioned generally in front of said muzzle end of said barrel when said base portion is in said mounting engagement with said accessory rail of said pistol, so that said plate portion will prevent said barrel of said pistol from being pushed rearwardly out of battery; and means for detachably locking said base portion in said mounting engagement with said accessory rail of said pistol, comprising:

a transverse bore formed through said mounting channel of said base portion so as to align with said locking notch in said accessory rail of said pistol when said base portion is in said mounting engagement therewith; and a pin member for being passed through said transverse bore so as to cooperate with said locking notch in said accessory rail to lock said base portion of said strike plate unit in said mounting engagement with said accessory rail.

2. The strike plate unit of claim 1, wherein said plate portion comprises:

a plate member for extending over said muzzle end of said pistol in a direction generally perpendicular to said barrel of said pistol when said base portion of said strike plate unit is in said mounting engagement with said accessory rail.

3. The strike plate unit of claim 2, wherein said plate member comprises:

a generally rectangular plate member configured to extend over substantially an entire forward end of both said barrel and said slide of said pistol when said base portion is in said mounting engagement with said accessory rail.

4. The strike plate unit of claim 2, wherein said plate portion comprises:

a rearward face that extends upwardly from said base portion so as to be positioned a spaced distance forward of said muzzle end of said barrel when said base portion is in mounting engagement with said accessory rail of said pistol, so as to form a gap through which gasses escape in upward and outward directions upon firing of said pistol and thereby create a compensating force that counters muzzle rise due to recoil of said pistol.

5. The strike plate unit of claim 4, wherein said gap has a spacing of about 1/32 inch.

6. The strike plate unit of claim 1, wherein said accessory rail of said pistol is formed of a polymeric material and has a predetermined width, and wherein said mounting channel in said base portion has a width sized slightly smaller than said width of said accessory rail of said pistol, so that said channel will cooperate with said polymeric material of said accessory rail to form a sliding interference engagement for stabilizing said strike plate unit on said pistol.

7. The strike plate unit of claim 6, wherein said width of said mounting channel is sized smaller than said width of said accessory rail by an amount in the range from about one thousandth of an inch to about three thousandths of an inch.

8. The strike plate unit of claim 1, wherein said plate portion comprises:

a forward face having large, pointed checkering that forms a plurality of spaced, sharply-pointed tips.

9. The strike plate unit of claim 8, wherein said sharply-pointed tips of said checkering lie substantially in a common plane, so that said forward face of said plate portion is substantially free of elongate, individual protrusions.

10. A strike plate unit for being mounted to a pistol having a slide and a barrel having a muzzle end, and an accessory rail located below said slide and barrel, said accessory rail having a locking notch formed therein, said strike plate unit comprising:

a base portion having a mounting channel formed in an upper side thereof for receiving said accessory rail of said pistol in sliding engagement therewith, so as to position said base portion generally beneath said slide and barrel of said pistol;

a transverse bore formed through said mounting channel of said base portion for aligning with said locking notch in said accessory rail when said base portion is in a predetermined mounting position thereon;

a pin member for being passed through said transverse bore so as to cooperate with said locking notch to lock said base portion in said predetermined mounting position on said accessory rail;

a plate portion that extends upwardly from said base portion so as to be positioned generally in front of said muzzle end of said pistol when said base portion is locked in said predetermined mounting position on said accessory rail, so as to prevent said barrel of said pistol from being pushed rearwardly out of battery, said plate portion being arranged to extend generally perpendicular to said barrel of said pistol and comprising:

a forward face having large, pointed checkering that forms a plurality of spaced, sharply-pointed tips; and a rearward face configured to be positioned a spaced distance forward of said muzzle end of said barrel when said base portion is locked in said predetermined mounting position on said accessory rail of said pistol, so as to form a gap of about 1/32 inch through which gasses escape in upward and outward directions upon firing of said pistol and thereby create a compensating force that counters muzzle rise due to recoil of said pistol; and a secondary accessory rail formed on a bottom side of said base portion for attachment of lights and other accessories thereto.

11. A strike plate unit that is mountable to a pistol having a slide and barrel having a muzzle end, and an accessory rail located below said slide and barrel, said accessory rail being formed of a polymeric material and having a predetermined width and locking notch formed therein, said strike plate unit comprising:

a base portion having a mounting channel on an upper side thereof for receiving said accessory rail of said pistol in mounting engagement therewith so as to position said base portion generally beneath said barrel of said pistol, said mounting channel in said base portion having a width sized slightly smaller than said predetermined width of said accessory rail of said pistol, so that said channel will cooperate with said polymeric material of said accessory rail to form a sliding interference engagement for stabilizing said strike plate unit on said pistol; and a plate portion that extends from said base portion so as to be positioned generally in front of a muzzle end of said pistol when said base portion is in said mounting engagement with said accessory rail of said pistol, so that said plate portion will prevent said barrel of said pistol from being pushed rearwardly out of battery.

12. The strike plate unit of claim 11, wherein said width of said mounting channel is sized smaller than said predetermined width of said accessory rail by an amount in the range from about one thousandth of an inch to about three thousandths of an inch.

13. A strike plate unit that is mountable to a pistol having a slide and a barrel having a muzzle, and an accessory rail located below said barrel and slide, said accessory rail having a locking notch formed therein, said strike plate unit comprising:

a base portion having a mounting channel on an upper side of thereof for receiving said accessory rail of said pistol in mounting engagement therewith so as to position said base portion generally beneath said barrel of said pistol; and a plate portion that extends from said base portion so as to be positioned generally in front of said muzzle end of said pistol when said base portion is in said mounting engagement with said accessory rail of said pistol, so that said plate portion will prevent said barrel of said pistol from being pushed rearwardly out of battery, said plate portion comprising a plate member configured to extend over said muzzle end of said pistol in a direction generally perpendicular to said barrel of said pistol, said plate portion comprising a forward face having large, pointed checkering that forms a plurality of spaced, sharply-pointed tips.

14. The strike plate unit of claim 13, wherein said sharply-pointed tips of said checkering lie substantially in a common plane, so that said forward face of said plate portion is substantially free of elongate, individual protrusions.

15. A strike plate unit that is mountable to a pistol having a slide and a barrel having a muzzle end, and an accessory rail located below said barrel and slide, said accessory rail having a locking notch formed therein, said strike plate unit comprising:

a base portion having a mounting channel on an upper side of thereof for receiving said accessory rail of said pistol in mounting engagement therewith so as to position said base portion generally beneath said barrel of said pistol; and a plate portion that extends from said base portion so as to be positioned generally in front of a muzzle end of said pistol when said base portion is in mounting engagement with said accessory rail of said pistol, so that said plate portion will prevent said barrel of said pistol from being pushed rearwardly out of battery, said plate portion comprising a plate member configured to extend over said muzzle end of said pistol in a direction generally perpendicular to said barrel of said pistol, said plate portion comprising a rearward face that extends upwardly from said base portion so as to be positioned a spaced distance forward of a muzzle end of said barrel so as to form a gap through which gasses escape in upward and outward directions upon firing of said pistol and thereby create a compensating force that counters muzzle rise due to recoil of said pistol.

16. The strike plate unit of claim 15, wherein said gap has a spacing of about 1/32 inch.

* * * * *